US007854813B2

(12) United States Patent
Sommer et al.

(10) Patent No.: US 7,854,813 B2
(45) Date of Patent: Dec. 21, 2010

(54) METHOD OF MANUFACTURING A NON-WOVEN FABRIC

(75) Inventors: Sebastian Sommer, Troisdorf (DE); Michael Baumeister, Troisdorf (DE)

(73) Assignee: Reifenhauser GmbH & Co. Maschinenfabrik, Troisdorf (DE)

( * ) Notice: Subject to any disclaimer, the term of this patent is extended or adjusted under 35 U.S.C. 154(b) by 1033 days.

(21) Appl. No.: 10/902,691

(22) Filed: Jul. 29, 2004

(65) Prior Publication Data

US 2005/0040565 A1 Feb. 24, 2005

(30) Foreign Application Priority Data

Aug. 20, 2003 (DE) ..... 103 38 196

(51) Int. Cl.
*D04H 3/14* (2006.01)
*B29C 65/66* (2006.01)

(52) U.S. Cl. ..... 156/85; 156/167; 156/181

(58) Field of Classification Search ..... 264/168, 264/211.17, 284, 293, 342 R, 342 RE; 425/463; 156/167, 181, 84, 85
See application file for complete search history.

(56) References Cited

U.S. PATENT DOCUMENTS

| | | | | | |
|---|---|---|---|---|---|
| 2,398,729 | A * | 4/1946 | Taylor et al. | ..... | 425/463 |
| 3,262,153 | A * | 7/1966 | Mercer et al. | ..... | 425/463 |
| 3,272,898 | A * | 9/1966 | Knee | ..... | 264/119 |
| 3,889,325 | A * | 6/1975 | Fleissner | ..... | 26/18.5 |
| 3,981,650 | A * | 9/1976 | Page | ..... | 425/72.2 |
| 4,734,311 | A * | 3/1988 | Sokolowski | ..... | 428/152 |
| 5,002,815 | A * | 3/1991 | Yamanaka et al. | ..... | 428/109 |
| 5,108,276 | A * | 4/1992 | Hartmann | ..... | 425/66 |
| 5,635,290 | A * | 6/1997 | Stopper et al. | ..... | 428/198 |
| 5,762,734 | A * | 6/1998 | DeLucia et al. | ..... | 156/73.2 |
| 6,103,181 | A * | 8/2000 | Berger | ..... | 264/555 |
| 6,887,423 | B2 * | 5/2005 | Van Trump et al. | ..... | 264/555 |
| 7,504,348 | B1 * | 3/2009 | Hagewood et al. | ..... | 442/401 |
| 2003/0134094 | A1 * | 7/2003 | Zafiroglu et al. | ..... | 428/198 |

* cited by examiner

*Primary Examiner*—Michael A Tolin
(74) *Attorney, Agent, or Firm*—Jonathan Myers

(57) ABSTRACT

A method for manufacturing a nonwoven fabric, wherein a layer of nonwoven fabric is made up of a fiber mixture of at least two different types of fibers is formed. The single nonwoven fabric layer is solidified. The solidified single nonwoven fabric layer is then subjected to heat treatment subject to the condition that shrinkage of at least one of the types of fibers is activated.

11 Claims, 1 Drawing Sheet

METHOD OF MANUFACTURING A NON-WOVEN FABRIC

FIELD OF THE INVENTION

The present invention relates to a method of manufacturing a nonwoven fabric, wherein a layer of nonwoven fabric comprising a fiber mixture of at least two different types of fibers is formed. The fibers preferably comprise filaments of thermoplastic plastic.

BACKGROUND OF THE INVENTION

Numerous methods for manufacturing nonwoven fabrics are known in practice. If nonwoven fabrics having high strength and high stiffness are produced, these nonwoven fabrics are generally distinguished by a relatively low thickness. In other words, these nonwoven fabrics are only relatively low in volume and thus frequently have an inadequate textile feel or hand. Special process steps for increasing the thickness or the volume, such as needling the nonwoven fabric are particularly uneconomical for the light nonwoven products typical in the hygiene area.

OBJECTS OF THE INVENTION

The object of the invention is to provide a method of the type specified initially with which the volume bulk or the thickness of a nonwoven fabric can be increased in a simple and inexpensive fashion.

SUMMARY OF THE INVENTION

This object is achieved in a method of manufacturing a nonwoven fabric, wherein a layer of nonwoven fabric comprising a fiber mixture of at least two different types of fibers is formed and the single nonwoven fabric layer is solidified or compacted and wherein the compacted single nonwoven fabric layer is then subjected to a heat treatment which activates shrinkage of at least one of the types of fibers.

The term "a single nonwoven fabric layer" according to one embodiment of the invention means a layer aggregate which is formed of a plurality of identical nonwoven fabric layers. Thus, a plurality of identical nonwoven fabric layers having identical fiber mixtures and thus identical shrinking properties are formed one on top of the other so that a virtually homogeneous layer aggregate is formed. In this case, it is within the scope of the invention that these identical spinning nonwoven fabric layer, which is then compacted and is preferably stabilized in a calender, also forms such a layer aggregate.

It is within the scope of the invention that the fibers of the fiber mixture comprise continuous fibers or filaments which appropriately consist of thermoplastic plastic. According to a very preferred embodiment of the invention, the single nonwoven fabric layer is present in the form of a homogeneous fiber mixture before the solidification. In other words, the at least two types of fibers are homogeneously distributed in the nonwoven fabric layer. In this context, homogeneously means that the fibers are distributed substantially homogeneously in the nonwoven fabric layer. In this connection it is in any case within the scope of the invention that no different layers or plies are formed with the different types of fibers. The use of the term fibers here is intended to include continuous strands as well as subdivided strands of relatively short length. It is furthermore within the scope of the invention that the two types of fiber of the fiber mixture exhibit different shrinkage behavior during heat treatment. The fiber mixture used according to the invention thus comprises a shrinkable fiber mixture whose different types of fibers shrink at different temperatures.

According to a very preferred embodiment of the invention, the different types of fibers forming the nonwoven fabric layer are produced using a single spinning tool. According to this embodiment, a nonwoven fabric layer according to the invention is thus suitably produced in a spinning shaft as mixed fiber laying. According to an especially preferred embodiment of the invention, a spinning tool is used within the scope of this embodiment which is normally used to produce bicomponent fibers or multicomponent fibers. In this case, the different components or the different types of fibers emerge from respectively different spinning orifices, nozzles, openings or capillaries of the spinning tool. An approximately equal spinning speed of the different components or the different types of fibers can be ensured by varying the respective hole densities and the throughputs per capillary.

It is furthermore within the scope of the invention that the two types of fibers consist of different plastics. According to a very preferred embodiment of the invention, at least one of the two types of fibers consists of at least one plastic from the group "polyolefin, polyester, polyamide". The two types of fibers can also consist of copolymers of these plastics. According to one embodiment, the first type of fiber consists of a polyolefin and the second type of fiber consists of a polyester. The polyolefin suitably consists of polyethylene terephthalate (PET) or polybutylene terephthalate (PBT). According to one embodiment of the invention one type of fiber of the fiber mixture consists of polypropylene and the second type of fiber of the fiber mixture consists of polyethylene terephthalate (PET). Another embodiment of the invention is characterized in that one type of fiber of the fiber mixture consists of polypropylene and that the second type of fiber consists of polybutylene terephthalate (PBT). According to another embodiment of the invention, the first type of fiber of the fiber mixture consists of polyethylene and the second type of fiber of the fiber mixture consists of polypropylene.

The fibers used for the fiber mixture preferably comprise monofilaments. However, it is fundamentally also within the scope of the invention that one type of fiber of the fiber mixture consists of multi-component fibers or multi-component filaments and especially of bicomponent fibers or bicomponent filaments. However, the use of monofilaments for the two or for all types of fibers of the fiber mixtures is preferred.

It is within the scope of the invention that the two types of fibers of the fiber mixture exhibit different shrinkage behaviors during the heat treatment. As a result of a special choice of the raw material for the fibers and/or by adjusting the spinning conditions, the different fiber components have different shrinkage potentials in a certain temperature range.

According to a very preferred embodiment which acquires quite particular importance within the scope of the invention, the single nonwoven fabric layer is solidified using a calender. In this case, it is within the scope of the invention that a calender roller or a pair of calender rollers is used for solidification. Preferably a calender roller or a pair of calender rollers is used, which has engraving points with average engraving-point distances over 1.5 mm, preferably over 2.5 mm. According to a preferred embodiment these are average engraving-point distances.

According to a preferred embodiment of the invention the heat treatment of the solidified nonwoven fabric layer is carried out using a warmed or heated fluid. The heat treatment is suitably carried out using hot air. In this respect, the heat treatment can be carried out in a hot-air furnace. For example, a drum drier can be used.

The different shrinkage of the two types of fibers is used during the heat treatment. In this case, the fiber component with the higher shrinkage draws the engraving points or connecting points together whereas the fiber components with the lower shrinkage must as it were change in thickness.

The invention is based on the knowledge that voluminous nonwoven fabric having excellent properties can be produced simply and cheaply by the method according to the invention. Relatively thick and voluminous nonwoven fabric with excellent textile feel is produced. It should be emphasized that the method can be carried out relatively cheaply and thus the nonwoven fabrics produced are also distinguished by favorable cost.

BRIEF DESCRIPTION OF THE DRAWING

The above and other objects, features, and advantages will become more readily apparent from the following description, reference being made to the accompanying drawing in which.

SPECIFIC DESCRIPTION

Figures 1, 2:
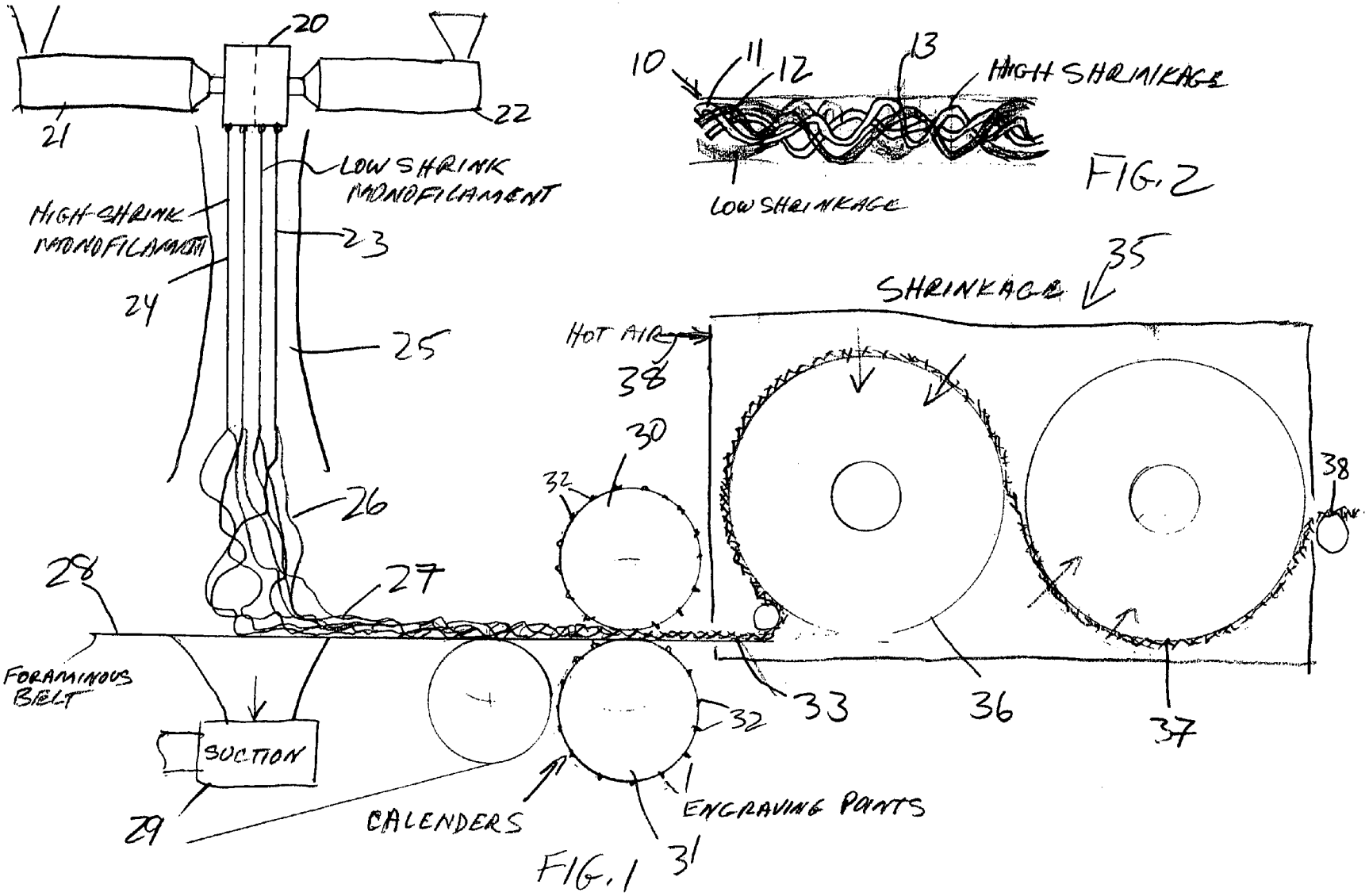
FIG. 1 is a flow diagram illustrating the method of making the nonwoven fabric.
FIG. 2 is a diagrammatic cross section through the fabric.

From FIG. 2 it will be apparent that the nonwoven fabric 10 made by the method of the invention is a single compressed layer 10 formed from at least two different types of fibers or filaments 11 and 12 which have been shown as unshaded and shaded, respectively to allow the fibers or filaments to be distinguished. The two types of fibers or filaments are produced by a single spinning tool and consist of different plastics, respectively labeled high shrinkage and low shrinkage respectively. At least one of the two types of fibers consists of a polyolefin, polyester or polyamide or a mixture thereof and one of the two types of filaments can have been thermally shrunk to a substantially greater extent than the other. The filaments may be bonded together at crossovers 13.

In FIG. 1, we have shown the apparatus for carrying out the method of the invention.

The apparatus can comprise a single spinning tool 20 which may be internally subdivided so that the spinning nozzles can be supplied with the two different plastics from respective plastifiers or extruders 21 and 22 and thus generate two different types of monofilament 23 and 24, respectively identified as a low shrinkage monofilament and a high shrinkage monofilament. The monofilaments as they emerge from the spinning tool 20 can be broken up in accordance with spun bond principles if desired.

Below an aerodynamic stretching zone 25, the filaments or fibers jumble together randomly at 26 to produce a thick nonwoven fabric or mat 27 consisting of a single nonwoven fabric layer in the form of a fiber or filament mixture of at least the two different types of fibers on a foranious belt 28 below which a suction is generated by a blower 29 to draw the fibers against the belt.

The single nonwoven fabric layer 27 is virtually homogeneous even if made up of identical nonwoven fabric layers which in the layer 27 cannot be distinguished from one another.

The nonwoven fabric, consisting of two types of fiber in the fiber mixture exhibiting different shrinkage behavior during heat treatment, is passed through a calender consisting of rollers 30 and 31 with engraving points 32 with a minimum of spacing of 1.5 mm and preferably 2.5 mm. The calendered compacted or solidified nonwoven fabric layer 33 is subjected to heat treatment at a temperature sufficient to shrink at least one of the types of filaments or fibers. The shrinkage unit 35 may comprise drums 36, 37 which are perforated and upon the surface of which the nonwoven fabric 33 is carried so that hot air fed at 38 to the unit 35 will pass through the nonwoven fabric into the evacuated drums. The finished fabric exits the drum dryer 35 at 38.

We claim:

1. A method of making a nonwoven thick and voluminous fabric having an excellent textile feel, the method comprising the steps of:

depositing a mixture of polypropylene monofilamentary fibers of a first type and polyethylene, polyethyleneterephthalate, polyethyleneterephthalate copolymer, polybutyleneterephthalate, or polybutyleneterephthalate copolymer monofilamentary fibers of a second different type from a single spinning tool on a foraminous belt so that identical nonwoven fabric layers having identical fiber mixtures, one on top of the other, form a nonwoven, virtually homogeneous layer aggregate with the two types of monofilamentary fibers homogeneously distributed in the nonwoven, virtually homogeneous layer aggregate, one of the types of monofilamentary fiber having a different shrinkage behavior and shrinking substantially more during heat treatment than the other type of fiber;

compacting the nonwoven virtually homogeneous layer aggregate between calender rolls into a compacted solidified nonwoven fabric layer such that the two different types of monofilamentary fibers are bonded together at crossovers; and heat treating the compacted solidified nonwoven fabric layer to thermally shrink the fibers of the one type substantially more than the fibers of the other type so as to shorten the fibers of the one type between the crossovers and increase thickness to yield the nonwoven fabric with an excellent textile feel.

2. The method defined in claim 1 wherein the calender rolls have engraving points with a spacing of at least 1.5 mm.

3. The method defined in claim 1 wherein the spacing is at least 2.5 mm.

4. The method defined in claim 1 wherein the heat treatment of the compacted nonwoven fabric layer to thermally shrink at least one of the types of fiber to yield the nonwoven fabric is carried out using a heated fluid.

5. The method defined in claim 4 wherein the heated fluid is hot air.

6. The method defined in claim 1 wherein the first type of fiber is polypropylene and the second type is polyethylene.

7. The method defined in claim 1 wherein the first type of fiber is polypropylene and the second type is polyethyleneterephthalate.

8. The method defined in claim 1 wherein the first type of fiber is polypropylene and the second type is a polyethyleneterephthalate copolymer.

9. The method defined in claim 1 wherein the first type of fiber is polypropylene and the second type is polybutyleneterephthalate.

10. The method defined in claim 1 wherein the first type of fiber is polypropylene and the second type is a polybutyleneterephthalate copolymer.

11. A method of making a thick and voluminous nonwoven fabric with excellent feel, the method comprising the steps of:

depositing a mixture of polypropylene monofilamentary fibers of a first type and polyethylene, polyethyleneterephthalate, polyethyleneterephthalate copolymer, polybutyleneterephthalate, or polybutyleneterephthalate copolymer monofilamentary fibers of a second different type from a single spinning tool on a foraminous belt so that identical nonwoven fabric layers having identical fiber mixtures, one on top of the other, form a nonwoven, virtually homogeneous layer aggregate with the two types of monofilamentary fibers homogeneously distributed in the nonwoven, virtually homogeneous layer aggregate, one of the types of monofilamentary fiber having a different shrinkage behavior and shrinking substantially more during heat treatment than the other type of fiber, the spinning tool of a type normally used to produce bicomponent fibers or multicomponent fibers;

compacting the nonwoven virtually homogeneous layer aggregate between calender rolls into a compacted solidified nonwoven fabric layer such that the two different types of monofilamentary fibers are bonded together at crossovers; and heat treating the compacted solidified nonwoven fabric layer to thermally shrink the fibers of the one type substantially more than the fibers of the other type so as to shorten the fibers of the one type between the crossovers and increase thickness to yield the nonwoven fabric with an excellent textile feel.

* * * * *